United States Patent [19]

Yasuda

[11] Patent Number: 4,668,072

[45] Date of Patent: May 26, 1987

[54] COPIER HAVING A DETACHABLE PHOTORECEPTOR UNIT

[75] Inventor: Hiroshi Yasuda, Yokohama, Japan

[73] Assignee: Ricoh Company, Ltd., Tokyo, Japan

[21] Appl. No.: 827,268

[22] Filed: Feb. 7, 1986

[30] Foreign Application Priority Data

Feb. 7, 1985 [JP] Japan ..... 60-15321[U]
Feb. 16, 1985 [JP] Japan ..... 60-19994[U]

[51] Int. Cl.[4] ..... G03G 15/00
[52] U.S. Cl. ..... 355/3 R; 355/3 BE
[58] Field of Search ..... 355/3 R, 3 BE, 3 DR, 355/16

[56] References Cited

U.S. PATENT DOCUMENTS 4,386,841 6/1983 Wakao et al. ..... 355/3 DR
4,563,077 1/1986 Komada ..... 355/3 R
4,609,277 9/1986 Yokoyama et al. ..... 355/3 R

*Primary Examiner*—R. L. Moses

*Attorney, Agent, or Firm*—Oblon, Fisher, Spivak, McClelland & Maier

[57] ABSTRACT

A copier includes a lower housing and an upper housing which is pivotally connected to the lower housing so as to be pivotted open and closed with respect thereto. An installation space is defined in the copier in which a unit having a photosensitive member may be detachably mounted. A pair of guide rails is fixedly provided on the upper housing and a pair of guide projections is fixedly provided on the unit, so that the pair of guide projections is slidingly engaged with the pair of guide rails, respectively, such that the unit may move between an inoperative position and an operative position. The lower housing is provided with a spring which imparts a biasing force to the unit so as to locate the unit at the operative position when the upper housing is pivotted closed with respect to the lower housing. In another embodiment, a locking mechanism is provided in the upper housing so as to releasably lock the unit at the operative position.

5 Claims, 8 Drawing Figures

COPIER HAVING A DETACHABLE PHOTORECEPTOR UNIT

BACKGROUND OF THE INVENTION

1. Field of the Invention

This invention generally relates to a copying machine, and, in particular, to an electrophotographic copier having a detachable photoreceptor unit.

2. Description of the Prior Art

An electrophotographic copier generally includes a photosensitive member, which is first charged to a predetermined polarity uniformly and then exposed to an original light image to form an electrostatic latent image on the photosensitive member, which is then developed typically by toner to form a visible toner image. The thus formed toner image is then transferred to a sheet of paper and fixed thereto to form a permanent copy image. The photosensitive member is typically provided in the form of a drum or an endless belt. It is often required that the photosensitive member be replaced with a new one for various reasons, such as maintenance. If the photosensitive member is provided rigidly, the replacement operation will be difficult and time-consuming. In order to allow to carry out the replacement of photosensitive members with ease and free of danger to impart any damages, there has been a need to develop a novel copier having a detachable photosensitive member unit.

SUMMARY OF THE INVENTION

In accordance with the present invention, there is provided a novel copier having a detachable photosensitive member unit, which comprises a lower housing, an upper housing having one end pivotally connected to the lower housing, first engaging means provided in the upper housing, a photosensitive member unit having second engaging means engageable with the first engaging means, and urging means provided in the lower housing for urging the photosensitive member unit into a predetermined position when the upper housing, in to which the photosensitive member unit is detachably mounted, is pivotted to a closed position. Preferably, the engagement between the first and second engaging means is such that the photosensitive member unit is movable between a first position, where the photosensitive member unit is not set in an operative position, and a second position, where the photosensitive member unit is set in an operative position, and the photosensitive member unit is set in the first position when the upper housing is pivotted open and in the second position when the upper housing is pivotted closed. Preferably, the copier is also provided with clamping means for clamping the upper housing to the closed position when the upper housing is pivotted closed. Thus, when the upper housing is to be pivotted open, the clamping means must first be released.

In accordance with another aspect of the present invention, the copier is further provided with locking means for locking the photosensitive member unit to the second position so that the photosensitive member unit remains to be held in the second position even if the upper housing is pivotted open and closed unless the locking means is set in the unlocked condition.

It is therefore a primary object of the present invention to provide an improved copier having a detachable photosensitive member unit.

Another object of the present invention is to provide a novel electrophotographic copying machine which allows to replace photosensitive members with ease and without danger of damaging any component.

A further object of the present invention is to provide an improved copier easy in maintenance.

Other objects, advantages and novel features of the present invention will become apparent from the following detailed description of the invention when considered in conjunction with the accompanying drawings.

DESCRIPTION OF THE PREFERRED EMBODIMENTS

Figure 1:
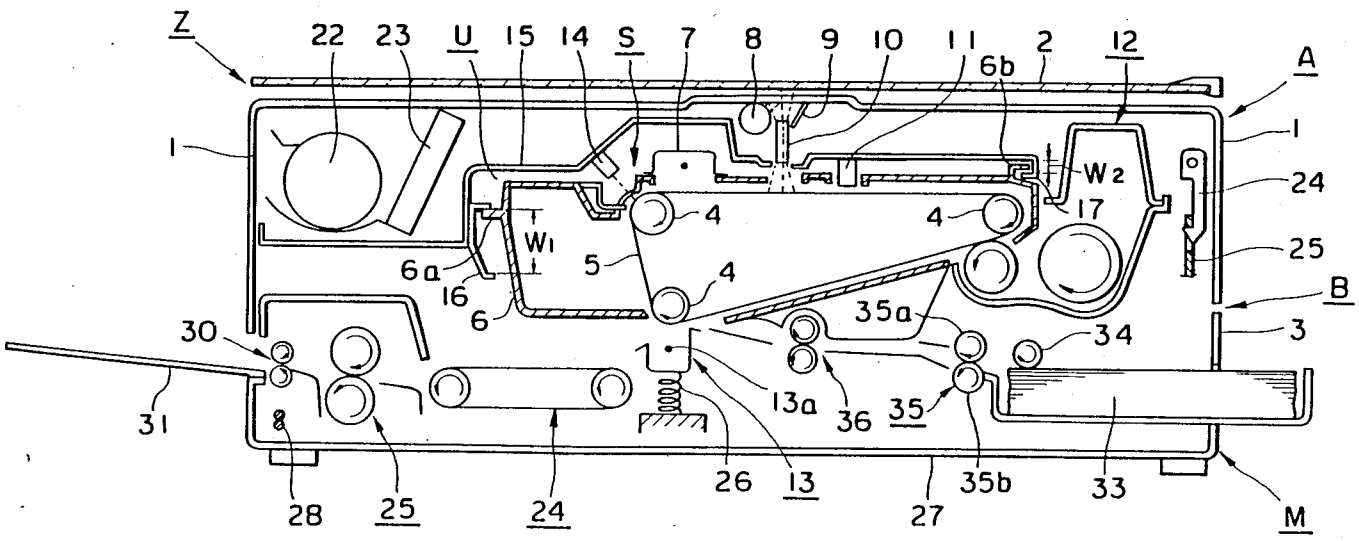
FIG. 1 is a schematic illustration showing the overall structure of an electrophotographic copying machine constructed in accordance with one embodiment of the present invention.

Referring now to FIG. 1, there is schematically shown an electrophotographic copying machine Z constructed in accordance with one embodiment of the present invention. As shown, the copying machine Z includes a contact glass plate 2 at its top for placing thereon an original document from which a copy is to be made. The copying machine Z also includes a main body M which is divided into an upper half A mounted on an upper housing 1 and a lower half B mounted on a lower housing 3. As will be made clear later, the lower housing 3 is stationarily provided and the upper housing 1 is pivotted at one end to the lower housing 3 so that the upper housing 1 may be pivotted open or closed with respect to the lower housing 3. An installation space S is defined generally at the center of the main body M and between the upper and lower halves, and a photosensitive member unit U may be detachably mounted in this installation space S. The photosensitive member unit U includes a frame 6, generally O-shaped in cross section, which rotatably supports three rollers 4 around which an endless photosensitive belt 5 is passed around. At least one of the rollers 4 is driven to rotate in the direction indicated by the arrow so that the endless photosensitive belt 5 advances clockwise as driven by the rollers 4.

The photosensitive member unit U includes a pair of left and right guide projections 6*a* and 6*b* provided integrally with the frame 6. As shown in FIG. 1, the left guide projection 6*a* extends horizontally to the right from a side wall of the frame 6 and the right guide projection 6*b* extends horizontally to the right from the top right corner of the frame 6. The upper housing 1 is fixedly provided with a pair of left and right guide rails 16 and 17. The left guide rail 16 is generally C-shaped and its opening is directed horizontally to the right and has a substantially large width $W_1$. On the other hand, the left guide rail 17 is generally inverted C-shaped and its opening is directed horizontally to the left and has a relatively small width $W_2$ which is large enough to slidably receive therein the corresponding guide projection 6*b*. Thus, when the photosensitive member unit U is set in position in the installation space S, the guide projections 6*a* and 6*b* are brought into engagement with guide rails 16 and 17, respectively. Since the width $W_1$ of the C-shaped guide rail 16 is relatively large, the photosensitive member unit U may pivot around the pivotal point defined by the engagement between the guide projection 6*b* and the guide rail 17 over an angle determined by the engagement between the left guide projection 6*a* and the top of the opening of the guide rail 16 and the engagement between the left guide projection 6*a* and the bottom of the opening of the guide rail 16. As will be described more in detail later, the photosensitive member unit U is set in an operative position when the left guide projection 6*a* is brought into engagement with the top of the opening of the left guide rail 16 as shown in FIG. 1; whereas, the photosensitive member unit U is set in an inoperative position when the left guide projection 6*a* is brought into engagement with the bottom of the opening of the left guide rail 16.

Around the endless photosensitive belt 5 are disposed various elements required to carry out an electrophotographic imaging process. Those elements include a primary corona charging device 7 which is fixedly mounted on the frame 6 of the photosensitive member unit U for charging the belt 5 uniformly to a predetermined polarity, an image exposing system comprised of an illumination lamp 8, a reflecting mirror 9 and a focusing lens 10, which are all fixedly mounted on the upper housing 1, for exposing an original light image to the belt 5 through a corresponding slit formed in the frame 6 to form an electrostatic latent image on the belt 5, an eraser lamp 11 also fixedly mounted on the upper housing 1 for removing the charge from an undesired portion of the belt 5, a developing device 12 fixedly mounted on the lower housing 3 for developing the electrostatic latent image formed on the belt 5 to form a toner image, an image transfer corona charging device 13 resiliently mounted on the lower housing 3 for transferring the toner image to a sheet of transfer medium, and a charge-removing lamp 14 fixedly mounted on the upper housing 1 for removing the residual charge from the belt 5 in the order mentioned along the direction of advancement of the belt 5. It is to be noted that, although not shown specifically, the photosensitive member unit U is preferably provided with a cleaning device as disposed between the transfer device 13 and the charge-removing lamp 14 for cleaning the residual toner from the belt 5.

As described previously in brief, the upper housing 1 is fixedly provided with a pair of left and right guide rails 16 and 17, both of which extend across the front and rear sides of the copying machine or perpendicular to the plane of the drawing. The photosensitive member unit U includes the pair of left and right guide projections 6*a* and 6*b* which are integral with the frame 6 and extend oppositely in the horizontal direction and also perpendicular to the plane of the drawing. Thus, when the photosensitive member unit U is fitted into the installation space S, the left and right guide projections 6*a* and 6*b* are slidably fitted into the guide rails 16 and 17, respectively. As mentioned before, the right guide rail 17 is generally in the shape of an inverted C and its opening width $W_2$ is relatively small and large enough to slidably receive therein the corresponding guide projection 6*b*. On the other hand, the left guide rail 16 is generally in the shape of C and its opening width $W_1$ is relatively large such that the photosensitive member unit U is pivotal over a predetermined angle around the engagement between the right guide projection 6*b* and the right guide rail 17. This pivotal angle is determined by the engagement of the left guide projection 6*a* with the top of the opening of the left guide rail 16 and the engagement of the left guide projection 6*a* with the bottom of the opening of the left guide rail 16. Thus, when the photosensitive member unit U is fitted into the installation space S, the left guide projection 6*a* comes into engagement with the bottom of the opening of the left guide rail 16 under the gravity force; however, when an upward biasing force is applied to the unit U, the unit U is pivotted clockwise over the predetermined angle until the left guide projection 6*a* comes into engagement with the top of the opening of the left guide rail 16, in which case the unit U is set in its operative position.

As also shown in FIG. 1, to the left of the installation space S are disposed a cooling fan 22 and an ozone filter 23 as fixedly attached to the upper housing 1. On the other hand, to the right of the installation space S is disposed a hook member 24 which is pivotally mounted on the upper housing 1. A stopper plate 25 formed with a hole at its top is fixedly attached to and extending upward from the lower housing 3 such that the hook member 24 comes into engagement with the hole of the stopper plate 25 when the upper housing 1 is brought into its closed position, whereby the upper housing 1 is held in its closed position through the engagement between the hook member 24 and the stopper plate 25.

As described previously, the image transfer corona charging device 13 is resiliently mounted on the lower housing 3. In the illustrated embodiment, the charging device 13 is attached to a bottom plate 27 of the lower housing 3 through a coil spring 26. Although not shown specifically, it is so structured that the charging device 13 is engageable with the frame 6 of the photosensitive member unit U. Thus, when the upper housing 1 is brought to its closed position as shown in FIG. 1 with the hook member 24 in engagement with the stopper plate 25, the charging device 13 is brought into resilient contact with the frame 6 of the photosensitive member unit U so that the unit U is pivotted upward around the engagement between the right guide projection 6*b* and the right guide rail 17 until the left guide projection 6*a* is brought into engagement with the top of the opening of the left guide rail 16, whereby the unit U is set in its operative position. Accordingly, a predetermined distance is established between the corona wire 13*a* of the charging device 13 and the surface of the photosensitive belt 5.

To the left of the charging device 13 is disposed an endless transportation belt 24 extending between a pair of rollers mounted on the lower housing 3, and a pair of image fixing rollers 25 is disposed to the left of the transportation belt 24. Thus, a sheet of paper moving past the image transfer corona charging device 13 receives a toner image from the photosensitive belt 5 and then passed through the image fixing rollers 25 whereby the toner image is permanently fixed to the sheet of paper. A pair of paper discharging rollers 30 is disposed downstream of the image fixing rollers 25 so that the sheet of paper having thereon the fixed toner image is discharged onto a paper tray 31 mounted on the lower housing 3 extending to the left thereof. In the illustrated embodiment, a torsion bar 28 is provided at the left bottom corner of the lower housing 3 so that the upper housing 1 is pivotal around the torsion bar 28. Thus, the upper housing 1 may be pivotted open or closed with respect to the lower housing 3 when it is pivotted counterclockwise or clockwise around the torsion bar 28. Accordingly, the upper and lower housings 1 and 3 may be pivotted open and closed as if an alligator yawns.

As shown in FIG. 1, to the right of the image transfer charging device 13 is disposed a paper feeding cassette 33 which stores therein a stack of sheets of paper. The cassette 33 may be detachably fitted into the lower housing 3. A pick-up roller 34 is disposed to be in contact with the topmost sheet of paper of the paper stack in the cassette 33, and it is driven to rotate intermittently so as to feed the sheets of paper one by one. A pair of feed controller rollers 35 is disposed at the supply end of the cassette 33 with the top roller **35*a* driven to rotate clockwise and the bottom roller 35*b* driven to rotate counterclockwise. Thus, when the topmost sheet of paper is fed by the pick-up roller 34, it is fed forward by the pair of feed controller rollers 35*a* and 35*b*. Also provided is a pair of registration rollers 36 downstream of the pair of feed controller rollers 35, and the pair of registration rollers 36 are intermittently driven to rotate in association with the movement of the endless photosensitive belt 5. Thus, the rollers 35 and 36 define a transportation path leading from the supply end of the cassette 33 to the image transfer charging device 13. As a result, the sheets of paper are moved past the image transfer charging device 13 in a proper timing with the movement of the endless belt 5**.

Figure 2:
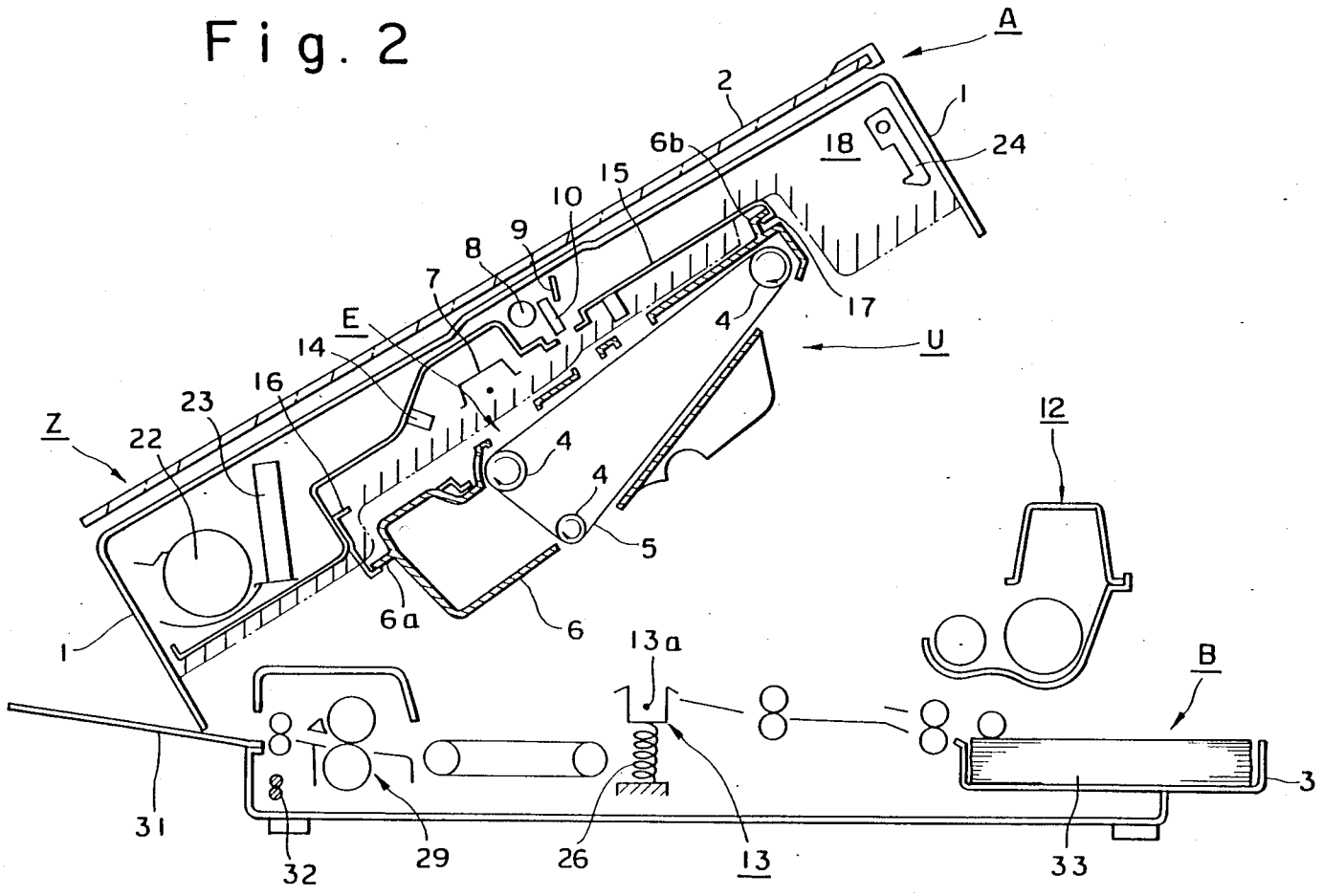
FIG. 2 is a schematic illustration showing the copying machine shown in FIG. 1 in the state when its upper housing is pivotted open with respect to its lower housing.
Figure 3:
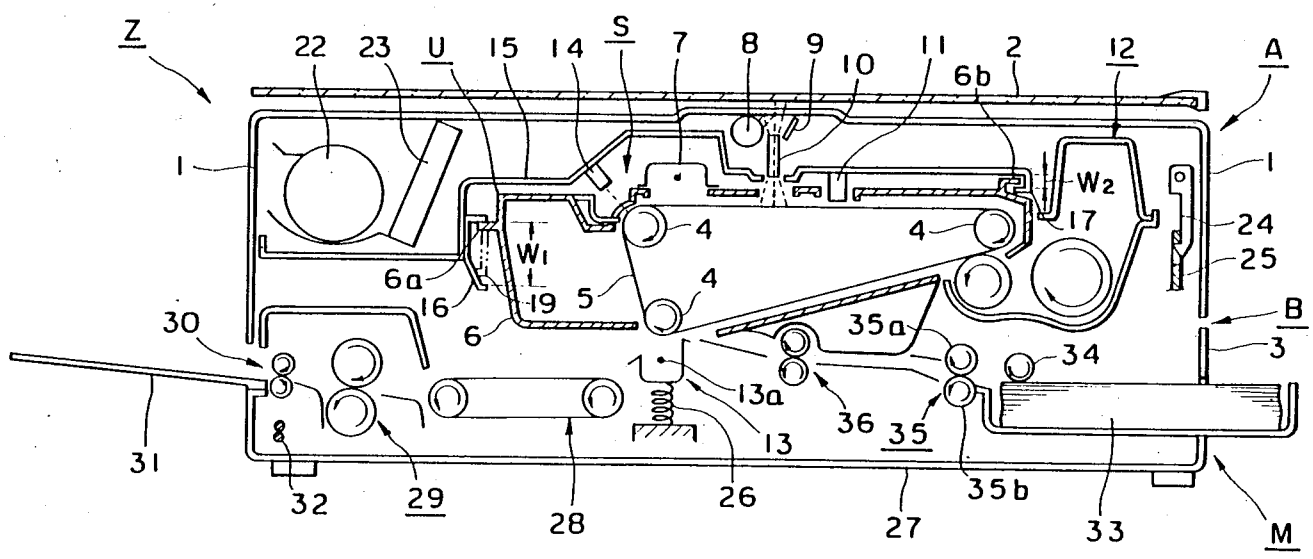
FIG. 3 is a schematic illustration showing the overall structure of an electrophotographic copying machine constructed in accordance with another embodiment of the present invention.
Figure 4:
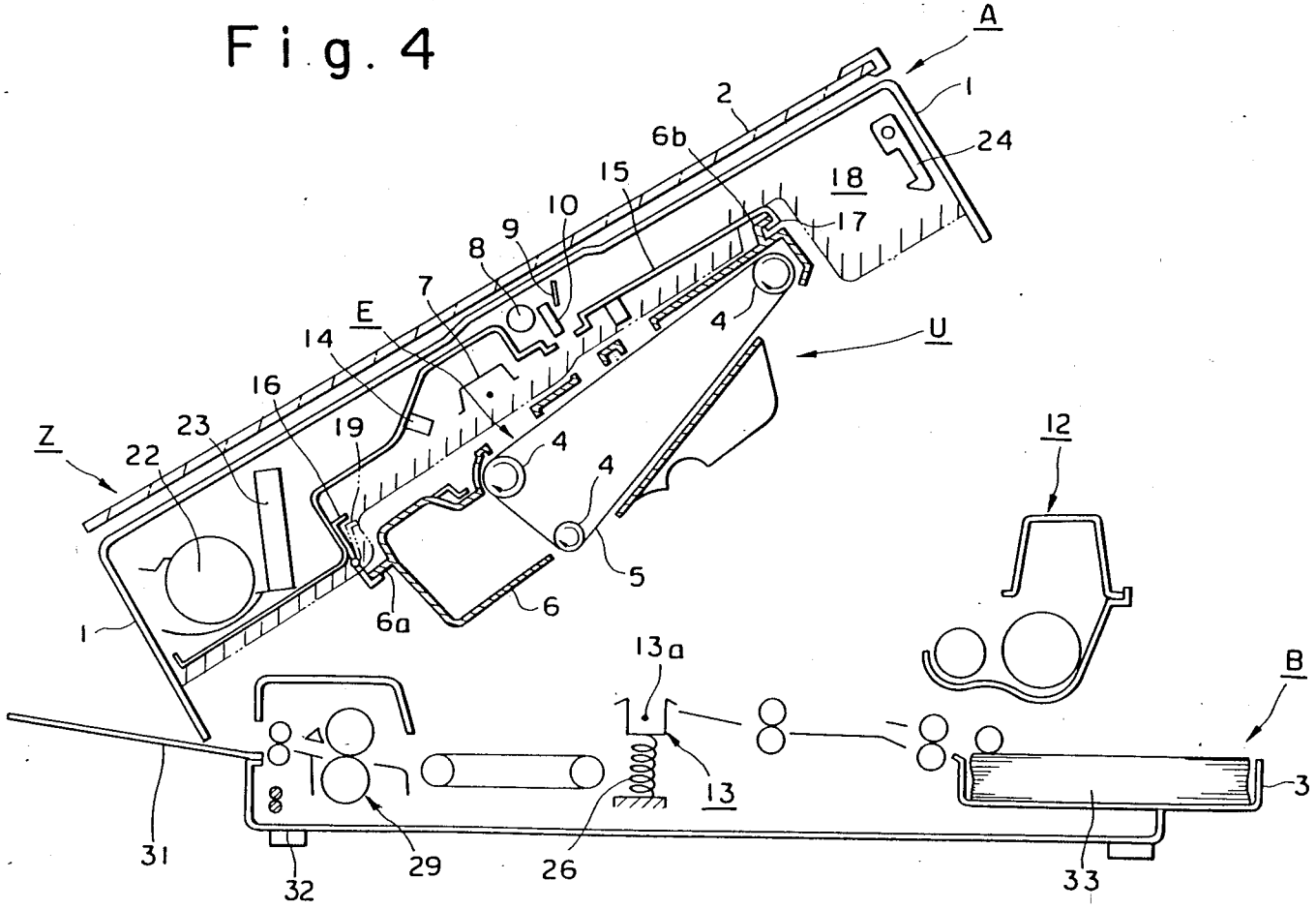
FIG. 4 is a schematic illustration showing the copying machine shown in FIG. 3 in the state when its upper housing is pivotted open with respect to its lower housing.

As best shown in FIG. 2, the upper housing 1 has a front plate 18 whose central bottom portion is removed to define a window E in compliance with a contour of the photosensitive member unit U so as to allow the unit U to be brought into or out of engagement with or from the pair of guide rails 16 and 17.

It will now be described as to how the photosensitive member unit U is mounted into or dismounted from the upper housing 1. In the first place, the hook member 24 is disengaged from the stopper plate 25 by pivotting the hook member 24 to be located away from the stopper plate 25. Then, the upper half A or upper housing 1 is pivotted around the torsion bar 28 counterclockwise over a predetermined angle until the upper half A takes the position shown in FIG. 2. Thus, the upper half A is separated away from the lower half B so as to expose various elements provided in the respective sections. Under the condition, lower portions of the guide rails 16 and 17 are the only elements which project into the installation space S. Thus, the photosensitive member unit U may be easily inserted into the installation space S through the window E with the pair of left and right guide projections **6*a* and 6*b* being brought into sliding engagement with the pair of left and right guide rails 16 and 17, respectively. In this case, since the left guide projection 6*a* is brought into sliding contact with the bottom of the opening of the left guide rail 16 under the influence of the gravity force, there is provided a sufficient gap between the photosensitive member unit U and the various elements mounted on the upper housing 1, so that the chance of the unit U being brought into contact with the various elements mounted on the upper housing 1** undesirably is minimized.

When the photosensitive member unit U has been pushed into a predetermined position through the sliding engagement between the guide projections **6*a* and 6*b* and the guide rails 16 and 17, respectively, the upper half A or upper housing 1 is pivotted clockwise to its closed position, whereby the hook member 24 becomes engaged with the stopper plate 25. During this pivotal motion, the top portion or an end block (not shown) mounted on the image transfer charging device 13 comes into contact with the frame 6 of the photosensitive member unit U, and, thus, as the upper half A is pivotted clockwise around the torsion bar 28, the photosensitive member unit U is pivotted clockwise around the engagement between the right guide projection 6*b* and the right guide rail 17 under the recovery force of the coil spring 26. As a result, the left guide projection 6*a* comes into engagement with the top of the opening of the left guide rail 16, whereby the unit U is set in its raised or operative position. A further clockwise pivotal motion of the upper half A does not cause any relative movement between the unit U and the upper housing 1, but the coil spring 26 is further compressed. Accordingly, due to the recovery force of the coil spring 26, the charging device 13 pushes the unit U upward so that the left guide projection 6*a* is securely pressed against the top of the opening of the left guide rail 16**.

It is to be noted that, when the unit U is set in its operative position as described above, the eraser lamp 11 is fitted into an opening formed in the frame 6. As described above, in accordance with the principle of the present invention, when the photosensitive member unit U is first inserted into the installation space defined in the upper housing and then the upper housing is brought into its closed position with respect to the lower housing, the unit U is set in its operative position with ease. If it is desired to detach the unit U, it is only necessary to first pivot the upper housing 1 open with respect to the lower housing 3 and then to pull the unit U forward.

Figure 6:
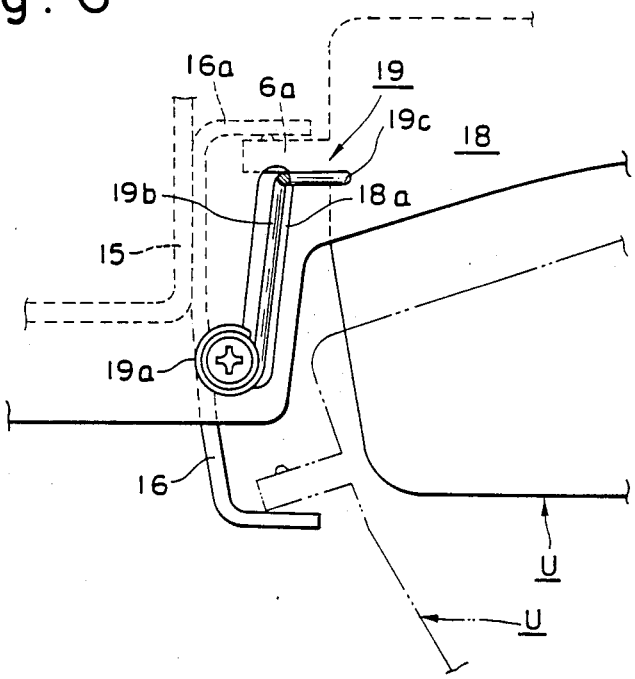
FIG. 6 is a fragmentary, schematic illustration showing the locking mechanism viewed in the direction indicated by V—V line in FIG. 5.
Figure 7:
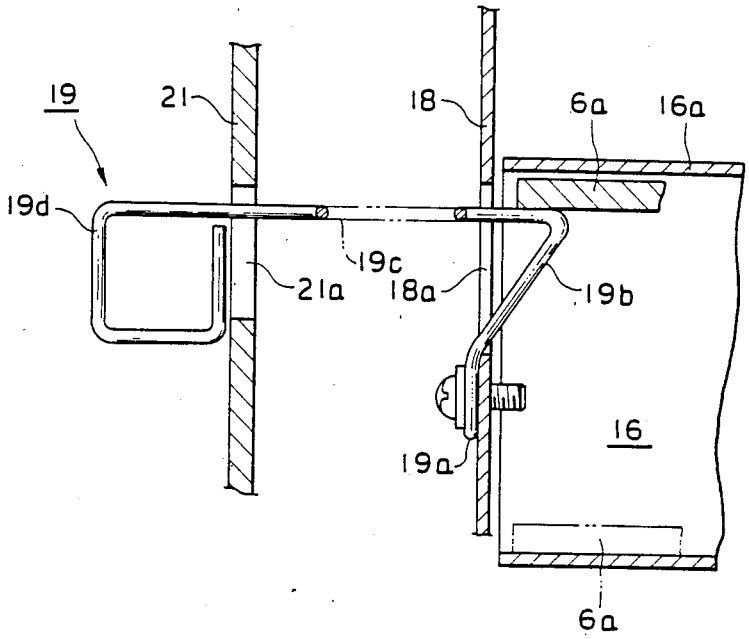
FIG. 7 is a fragmentary, schematic illustration showing the locking mechanism viewed in the direction indicated by VI—VI line in FIG. 5.

Now, another embodiment of the present invention will be described with respect to FIGS. 3 through 8. As shown, the electrophotographic copying machine constructed in accordance with this embodiment is very similar to the previously described embodiment in many respects, and, thus, like elements are indicated by like numerals. The second embodiment shown in FIGS. 3 and 4 differs from the previously described embodiment shown in FIGS. 1 and 2 because of the provision of a locking member 19 between the left guide projection **6*a* of the photosensitive member unit U and the left guide rail 16. The locking member 19 is comprised of a resilent wire and it has a base end 19*a* fixedly attached to the front plate 18 of the upper housing 1 by means of a screw 20. As best shown in FIG. 7**, the locking member 19 has an inclined section 19*b* which extends from the base end 19*a* obliquely toward the interior of the upper housing 1 through a slot 18*a* formed in the front panel 18. It is to be noted that the inclined section 19*b* extends into the opening of the left guide rail 16 such that it interferes with the left guide projection 6*a* of the unit U. As will be made clear later, the inclined section 19*b* may be moved out of the opening of the left guide rail 16 so as to be located out of interference with the movement of the left guide projection 6*a* inside of the opening of the left guide rail 16.

Figure 5:
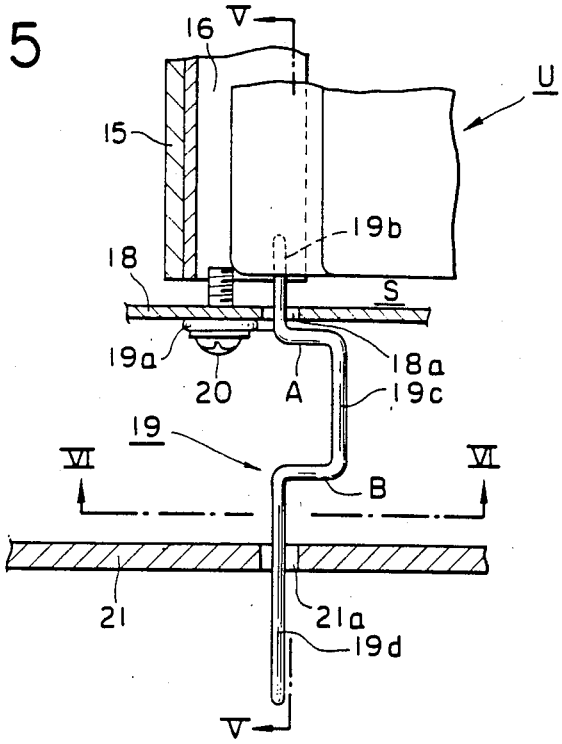
FIG. 5 is a fragmentary, schematic illustration showing a locking mechanism provided in the copying machine shown in FIGS. 3 and 4.

As best shown in FIG. 5, the locking member 19 also includes a generally rectangularly shaped stopper section 19*c* adjacent to the inclined section 19*b*, and the locking member 19 extends through a hole 21*a* formed an inner cover 21 fixedly attached to the upper housing 1 and terminates with a holding section 19*d* bent generally in the shape of a square. The locking member 19 is generally so biased that the portion A of the stopper section 19*c* is pressed against the front panel 18, whereby the inclined section 19*b* takes the position to interfere with the movement of the left guide projection 6*a* within the opening of the left guide rail 16. The holding section 19*d* of the locking member 19 may be grabbed and pulled forward until the portion B of the stopper section 19*c* comes to be abutted against the inner cover 21, whereby the inclined section 19*b* is moved out of the opening of the left guide rail 16 so that the movement of the left guide projection 6*a* is not interfered. It will be easily appreciated that the locking member 19 is prevented from being rotated around the screw 19*a* through engagement with the slot 18*a* which extends generally vertically.

Figure 8:
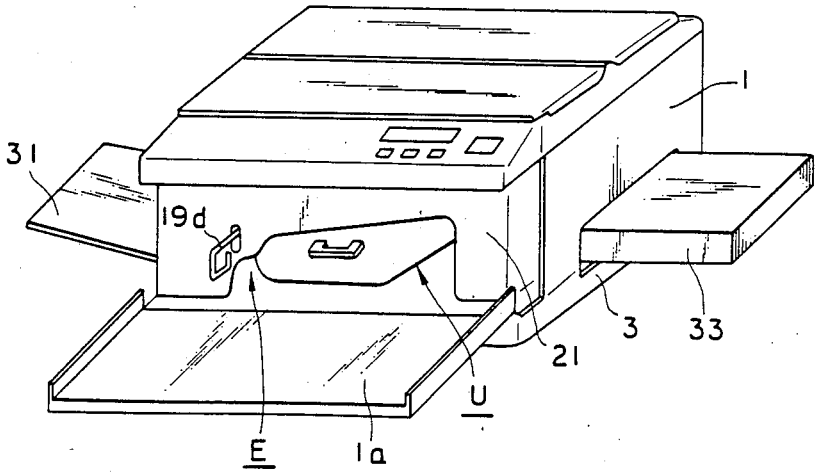
FIG. 8 is a schematic, perspective illustration showing the overall outlook of the copying machine shown in FIGS. 3 and 4 with its front cover 1*a* pivotted open.

The mounting and dismounting operation of the photosensitive member unit U into and out of the upper housing 1 will now be described. As shown in FIG. 8, a front outer cover 1*a* is first pivotted open, and, then, after disengaging the hook member 24 from the stopper plate 25, the upper housing 1 is pivotted around the torsion bar 32 in the counterclockwise direction until it takes the open position shown in FIG. 4. Then, the photosensitive member unit U is pushed into the installation space S with its left and right guide projections 6*a* and 6*b* in engagement with the left and right guide rails 16 and 17. Then, the upper housing 1 is pivotted clockwise around the torsion bar 32 toward its closed position where the upper housing 1 is brought into mating contact with the lower housing 3. During this pivotal motion, the photosenstive member unit U comes into contact with the spring-biased charging device 13 so that the unit U is pivotted clockwise around the engagement between the right guide projection 6*b* and the right guide rail 17 until the left guide projection 6*a* comes into abutment against the top of the opening of the left guide rail 16. As shown in FIG. 6, when the left guide projection 6*a* moves from its lowered or inoperative position indicated by the two-dotted line and in engagement with the bottom of the opening of the left guide rail 16 to its raised or operative position indicated by the dotted line and in engagement with the top of the opening of the left guide rail 16, the forward end of the left guide projection 6*a* slides along the inclined section of the locking member 19, whereby the locking member 19 is first pushed outward, thereby allowing the left guide projection 6*a* to move toward the top 16*a* of the opening of the left guide rail 16, and then the inclined section 19*b* returns to its original inward position when the left guide projection 6*a* comes into abutment against the top end of the left guide rail 16, thereby causing the left guide projection 6*a* to be locked between the top end 16*a* of the left guide rail 16 and the locking member 19. As a result, the unit U is securely locked at its operative position. Accordingly, thereafter, even if the upper half A is pivotted open with respect to the lower half B so that the biasing force of the coil spring 26 is not applied to the unit U, the unit U remains at its operative position by means of this locking member 19.

On the other hand, when the unit U is to be detached, the front outer cover 1*a* is first pivotted open, and, then, while pulling the holding section 19*d* of the locking member 19, the upper half A is pivotted open with respect to the lower half B. Of course, in this case, the hook member 24 must be disengaged from the stopper plate 25. When the holding section 19*d* is pulled, the inclined section 19*b* is moved out of the left guide rail 16 so that the left guide projection 6*a* of the unit U may come into sliding contact with the bottom end of the left guide rail 16. And, thus, the unit U may be pulled out of the upper housing 1 through the window E.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A copier comprising:

a lower housing;

an upper housing pivotally connected to said lower housing, said upper housing being pivotal between a closed position, where said upper housing is in mating contact with said lower housing, and an open position where said upper housing is located away from said lower housing;

a photosensitive member unit detachably mountable in an installation space defined in said copier;

first engaging means fixedly provided on said upper housing;

second engaging means fixedly provided on said photosensitive member unit, said second engaging means being slidably engageable with said first engaging means such that said photosensitive member unit is movable between a first position where said unit is located not in an operative position and a second position where said unit is located in the operative position; and urging means provided in the lower housing for urging said photosensitive member unit into said second position when said upper housing, into which said photosensitive member unit is detachably mounted, is pivotted to said closed position.

2. The copier of claim 1 wherein said upper housing is pivotally connected to said lower housing at one end thereof so that said upper and lower housings may pivot open and closed as if an alligator yawns.

3. The copier of claim 1 wherein said first engaging means includes a pair of guide rails spaced apart over a predetermined distance, and said second engaging means includes a pair of guide projections which are slidingly engageable with said pair of guide rails, respectively.

4. The copier of claim 3 wherein said urging means includes a spring.

5. The copier of claim 1 further comprising locking means for locking said unit to said second position.

* * * * *